US011708960B1

(12) United States Patent
Ingalls et al.

(10) Patent No.: US 11,708,960 B1
(45) Date of Patent: Jul. 25, 2023

(54) LIGHT FIXTURES WITH PLIABLE DIFFUSER SHADE

(71) Applicant: ABL IP Holding LLC, Atlanta, GA (US)

(72) Inventors: Zachary Adam Ingalls, Littleton, CO (US); Dominic Matthew Large, Broomfield, CO (US); Carl T. Gould, Golden, CO (US); Ryan Matthew Walker, Colorado Springs, CO (US); Christopher Jay Sorensen, Arvada, CO (US); Dirk Zylstra, Montreal (CA); Alexis Rondeau, Montreal (CA)

(73) Assignee: ABL IP HOLDING LLC, Atlanta, GA (US)

( * ) Notice: Subject to any disclaimer, the term of this patent is extended or adjusted under 35 U.S.C. 154(b) by 0 days.

(21) Appl. No.: 17/885,741

(22) Filed: Aug. 11, 2022

(51) Int. Cl.
*F21V 1/06* (2006.01)
*F21V 1/16* (2018.01)

(52) U.S. Cl.
CPC . *F21V 1/06* (2013.01); *F21V 1/16* (2013.01)

(58) Field of Classification Search
CPC ..... F21V 1/00; F21V 1/02; F21V 1/06; F21V 1/12; F21V 1/14; F21V 1/143; F21V 1/146; F21V 1/16
See application file for complete search history.

(56) References Cited

U.S. PATENT DOCUMENTS 10,845,042 B1 * 11/2020 Shellman ..... F21V 1/06
2019/0063721 A1 * 2/2019 Chun ..... F21V 23/06
2021/0080074 A1 * 3/2021 Chen ..... F21V 1/02

* cited by examiner

*Primary Examiner* — Anne M Hines
(74) *Attorney, Agent, or Firm* — Kilpatrick Townsend & Stockton LLP

(57) ABSTRACT

A light fixture having a light engine with at least one light source and a shade formed of a light transmissive, pliable material adapted to diffuse light emitted from the at least one light source outwardly from the light fixture. In some embodiments, the light transmissive, pliable material is a fabric material.

21 Claims, 13 Drawing Sheets

LIGHT FIXTURES WITH PLIABLE DIFFUSER SHADE

FIELD OF INVENTION

The present technology relates to light fixtures, and more particularly to light fixtures that have a pliable diffuser shade to diffuse light emitted from the light fixture.

BACKGROUND OF INVENTION

Light fixtures having large luminous surfaces are often used to illuminate large residential and commercial spaces. Such large luminous surface are desired for architectural scale and to reduce average surface brightness and the associated potential for glare while still providing a high total light output. Typically, these luminaires are comprised of large rigid plastic diffuse panels to create luminous surfaces, making them unable to collapse and thus necessitating increased packaging and warehousing footprints, increased weight, and, subsequently, an increased level of shipping associated carbon emissions.

BRIEF SUMMARY

The terms "invention," "the invention," "this invention" and "the present invention" used in this patent are intended to refer broadly to all of the subject matter of this patent and the patent claims below. Statements containing these terms should be understood not to limit the subject matter described therein or to limit the meaning or scope of the patent claims below. Embodiments of the invention covered by this patent are defined by the below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

An embodiment of the present invention relates to a light fixture having a light engine with at least one light source and a shade formed of a light transmissive, pliable material adapted to diffuse light emitted from the at least one light source outwardly from the light fixture.

BRIEF DESCRIPTION OF THE DRAWINGS

The disclosure will be readily understood by following detailed description in conjunction with the accompanying drawings, in which.

DETAILED DESCRIPTION

Figure 1:
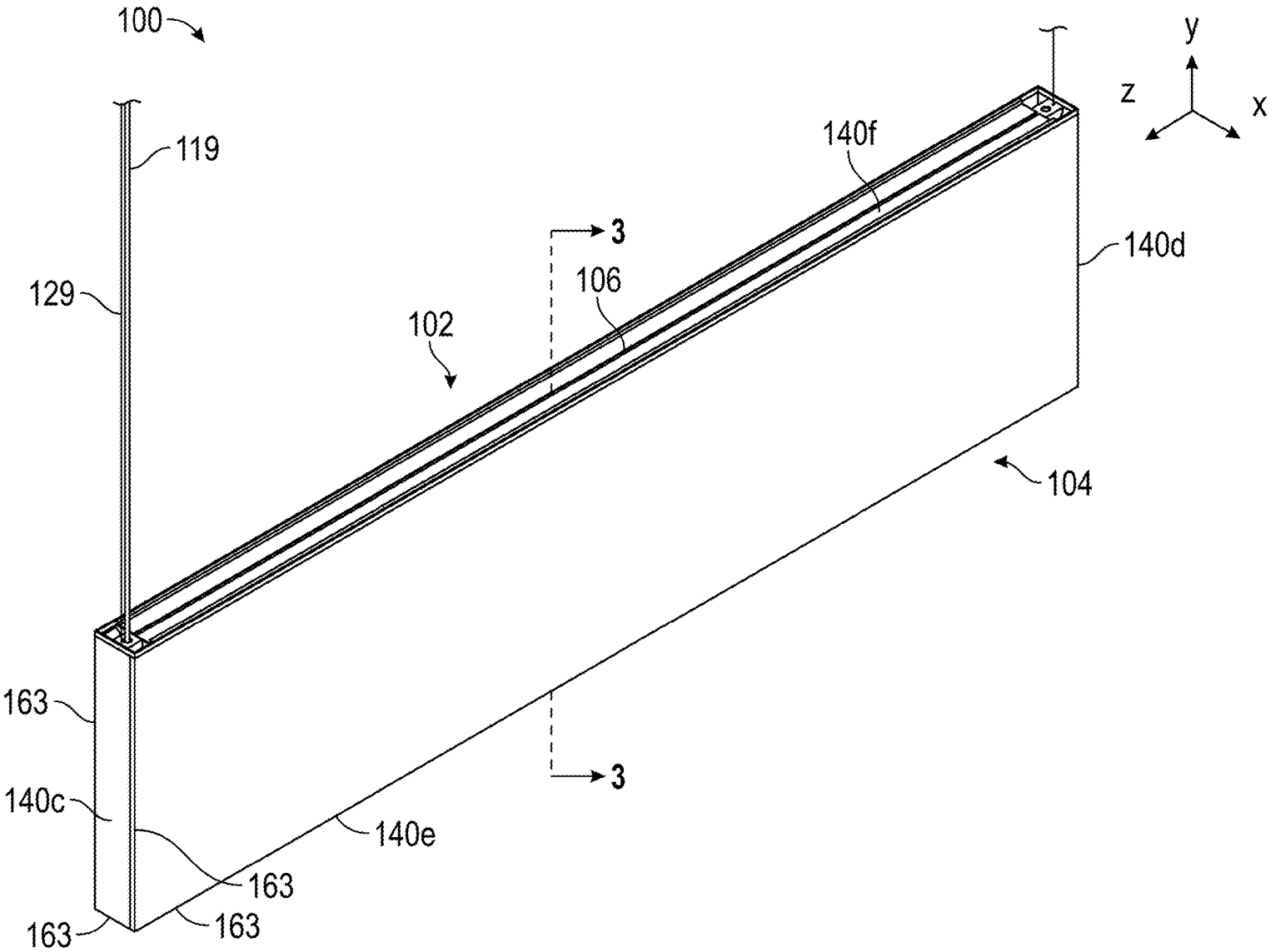
FIG. 1 is a perspective view of an embodiment of a light fixture in accordance with the present disclosure.

The subject matter of embodiments of the present invention is described here with specificity to meet statutory requirements, but this description is not intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Each example is provided by way of illustration and/or explanation, and not as a limitation. For instance, features illustrated or described as part of one embodiment may be used on another embodiment to yield a further embodiment. Upon reading and comprehending the present disclosure, one of ordinary skill in the art will readily conceive many equivalents, extensions, and alternatives to the specific, disclosed luminaire types, all of which are within the scope of embodiments herein.

In the following description, positional terms like "above," "below," "vertical," "horizontal," "bottom," "top," and the like are sometimes used to aid in explaining and specifying features illustrated in the drawings as presented, that is, in the orientation in which labels of the drawings read normally. These meanings are adhered to, notwithstanding that the luminaires herein may be mounted to surfaces that are not horizontal. When light is said to be emitted "downwardly" at least most of such light is emitted across one or more angles that are below horizontal when a luminaire is oriented as shown in the drawings; such angles include nadir but are not limited to nadir. Similarly, when light is said to be emitted "upwardly" at least most of such light is emitted across one or more angles that are above horizontal when a luminaire is oriented as shown in the drawings; such angles include zenith but are not limited to zenith.

FIG. 1 shows a perspective view of an embodiment of a light fixture 100. The light fixture 100 generally includes a light engine 102 and a shade 104. The light engine 102 in this illustrated embodiment is positioned proximate the top of the light fixture 100 to emit light downwardly when the light fixture 100 is installed, and the shade 104 couples to and extends downwardly from the light engine 102. However, in other embodiments, the light engine 102 may be located proximate the bottom of the light fixture 100 to emit light upwardly and the shade 104 may extend upwardly from the light engine 102.

Figure 2:
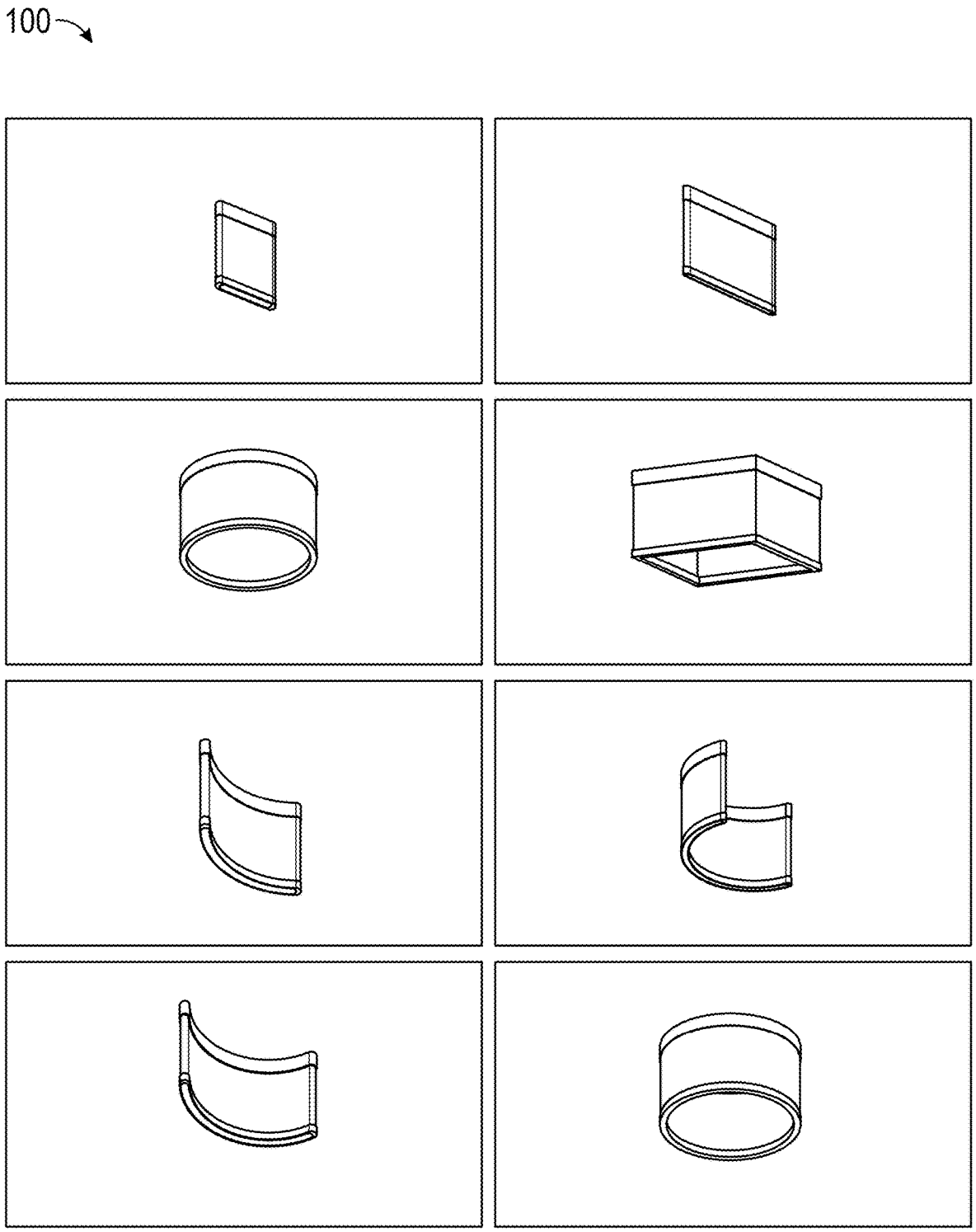
FIG. 2 shows perspective view of other embodiments of light fixtures in accordance with the present disclosure.

The light fixture 100 is shown as having a generally rectangular shape; however, the light fixture 100 may have any desirable shape, including, but not limited to, curved, cylindrical, conical, etc. FIG. 2 schematically illustrates a variety of other shapes that embodiments of the light fixtures described herein may assume.

The light fixture 100 may be suspended from a ceiling or other structure using at least one suspension cable 129. The suspension cable 129 may extend from the light engine 102 to support the light fixture 100. In addition, a power cable 119 may also extend from the ceiling or structure to the light engine 102 to provide power to the light sources within the light engine 102.

Figure 3:
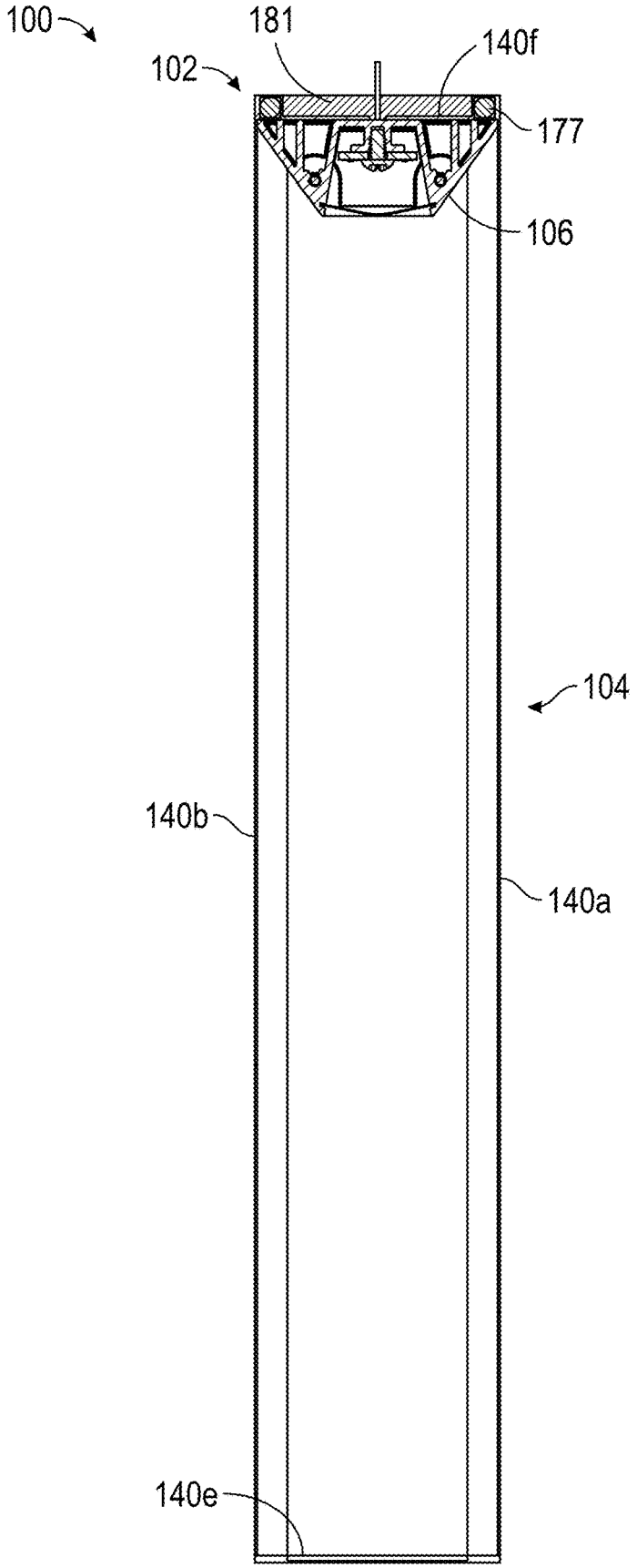
FIG. 3 is a cross-sectional view of the light fixture of FIG. 1 take along line 3-3.
Figure 5:
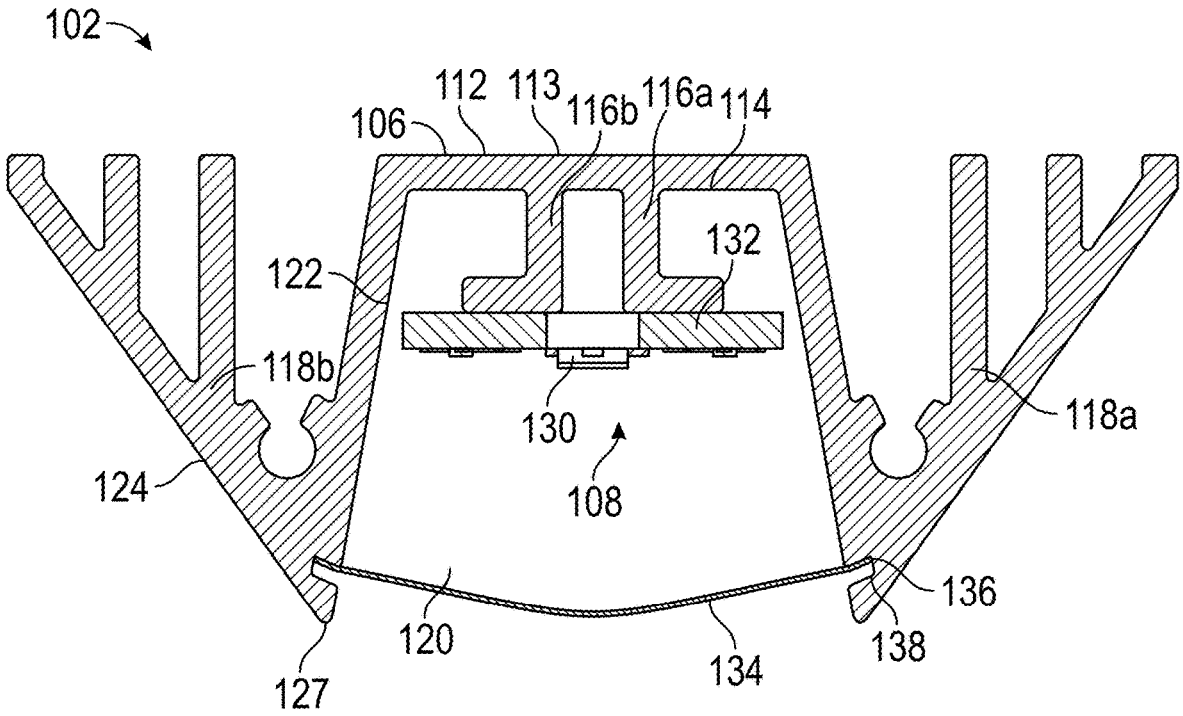
FIG. 5 is a cross-sectional view of the light engine of FIG. 4 taken along line 5-5.

With reference to FIGS. 3 and 5, the light engine 102 includes a mount body 106, one or more light sources 108 supported on the mount body 106, and an optical film 134 supported on the mount body 106 to diffuse light emitted by the light sources 108. The mount body 106 includes a top plate 112 having a top surface 113 and a bottom surface 114 from which two mounting feet 116*a*, 116*b* extend. Lateral wings 118*a*, 118*b* extend from each side of the top plate 112 such that a channel 120 is formed along the mount body 106. Each lateral wing 118*a*, 118*b* has an inner wall 122 and an outer wall 124 that meet at a lower edge 127. In some embodiments, the inner walls 122 and/or the outer walls 124 of the lateral wings 118*a*, 118*b* are rendered reflective, either by application of a reflective paint or other reflective materials. In some embodiments, the inner and outer walls 122, 124 are angled relative to each other such that the outer wall 124 angles upwardly and outwardly from the lower edge 127 relative to the inner wall 122. In this way, the outer walls 124 form beveled surfaces for reflection, as described in more detail below.

Figure 4:
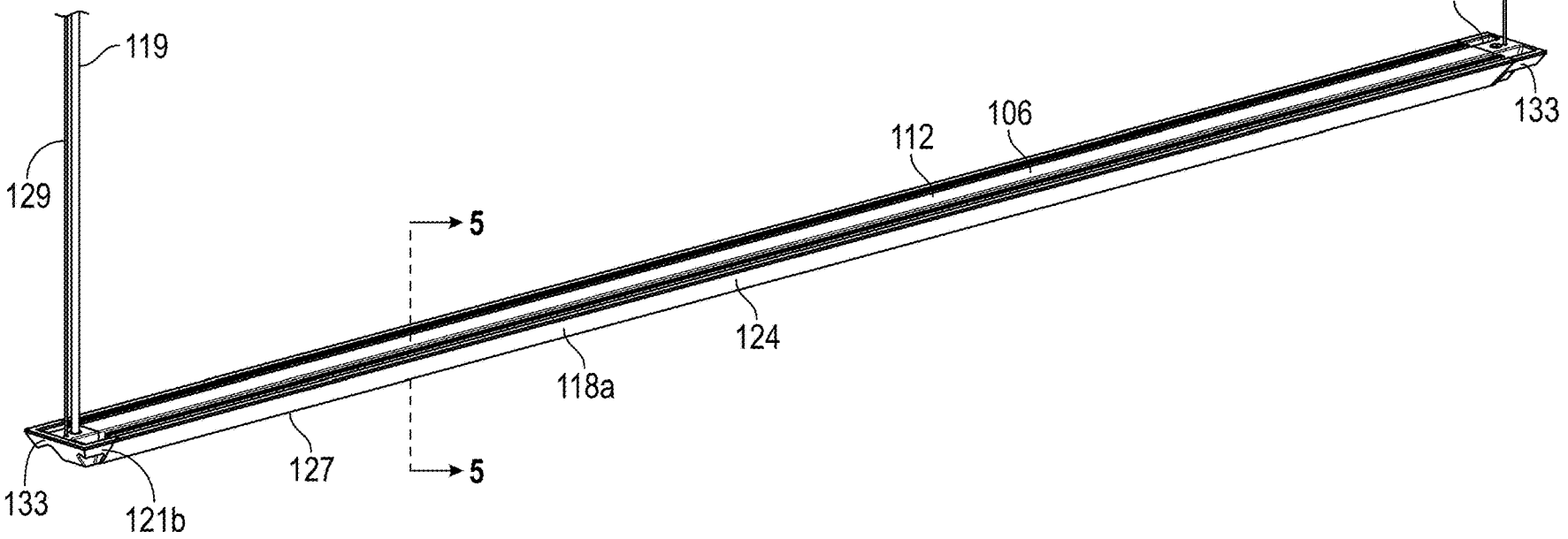
FIG. 4 is a perspective view of the light engine of FIG. 1 in isolation.

The lateral sides of the channel 120 are defined by the inner walls 122 of lateral wings 118*a*, 118*b*. The channel 120 may extend entirely or only partially along the length of the mount body 106. As shown in FIG. 4, end caps 121*a*, 121*b* may be positioned on the longitudinal ends of the mount body 106 as to enclose the channel 120 and provide additional structure to the mount body 106. The end caps 121 may include beveled outer walls 133, which can be, but do not have to be, oriented at the same angle as outer walls 124 of the mount body 106.

The mount body 106 may be formed of any material having sufficient structural integrity and rigidity. Suitable materials include, but are not limited to, polymeric or metallic (e.g., steel, aluminum, etc.) materials. The mount body 106 may be formed using various methods, including, but not limited to, molding, extruding, casting, etc. In some embodiments, the mount body 106 is formed from extruded aluminum given the relatively lightweight nature of this material and its efficient thermal management properties. Formation via an extrusion process is a cost-effective and simple way to manufacture mount bodies 106 of different lengths. The mount body 106 may be formed of any length depending on the desired scale of the light fixture 100. Moreover, the mount body 106 may extend along an entirely linear path (i.e., have one longitudinal axis) or, in other embodiments, the mount body 106 may assume other non-linear shapes (e.g., curved, circular, zigzag, etc.), depending on the intended geometry of the light fixture 100. One of skill in the art will understand that the geometry of the mount body 106 illustrated in the figures is for illustrative purposes only and should not be considered limiting on embodiments of the present invention.

The light sources 108 are supported on the mount body 106 to emit light into the channel 120. The light sources 108 are illustrated as mounted onto mounting feet 116*a*, 116*b* but could be mounted at other locations and in other ways on the mount body 106. In some embodiments, the light sources 108 are light emitting diodes (LED) 130 positioned on one or more printed circuit boards (PCB) 132, but other light sources, such as but not limited to incandescent, halogen, or fluorescent light sources, are certainly contemplated herein.

An optical film 134 is oriented relative to the mount body 106 to diffuse and/or shape the light emitted by the light sources 108. The optical film 134 may be formed from any suitable material. In embodiments, the optical film 134 is formed of a polymeric material, such as, but not limited to, polyethylene terephthalate (PET). In some embodiments, the optical film 134 is designed to reduce high angle light such that more of the emitted light is directed downwardly out of the channel 120. Texturing or other enhancements may be provided on and/or within the optical film 134 to help accomplish this. In some embodiments, at least one surface of the optical film 134 is provided with conical microstructures.

In the illustrated embodiment, the optical film 134 spans the width and covers the opening of the channel 120 (defined between the inner walls 122). In the illustrated embodiment, the opposing lateral edges 136 of the optical film 134 are positioned within notches 138 formed in the inner walls 122 of lateral wings 118*a*, 118*b*. However, the optical film 134 could be retained relative to the light sources 108 in other ways.

Figure 6B:
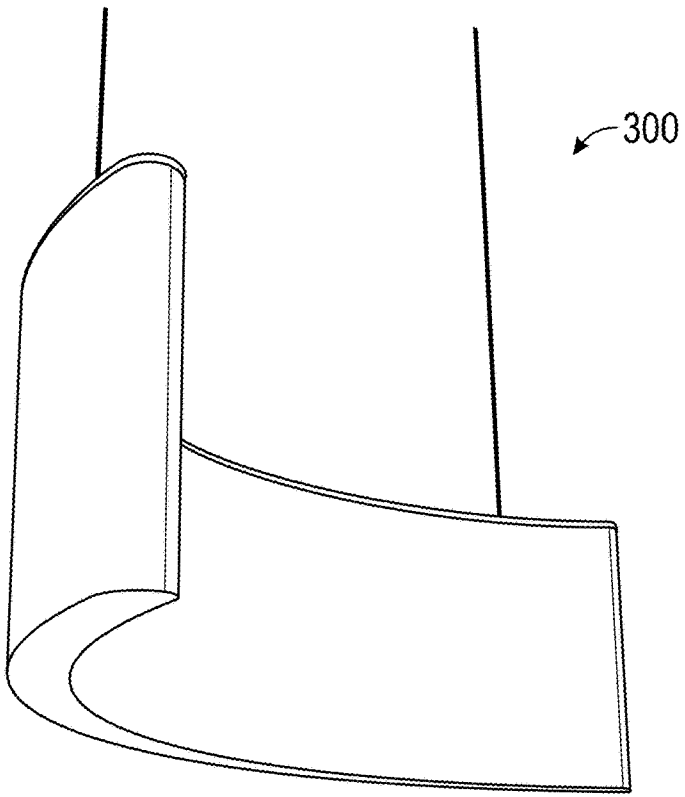
FIG. 6B is a perspective view of yet another embodiment of the light fixture in accordance with the present disclosure.
Figure 6A:
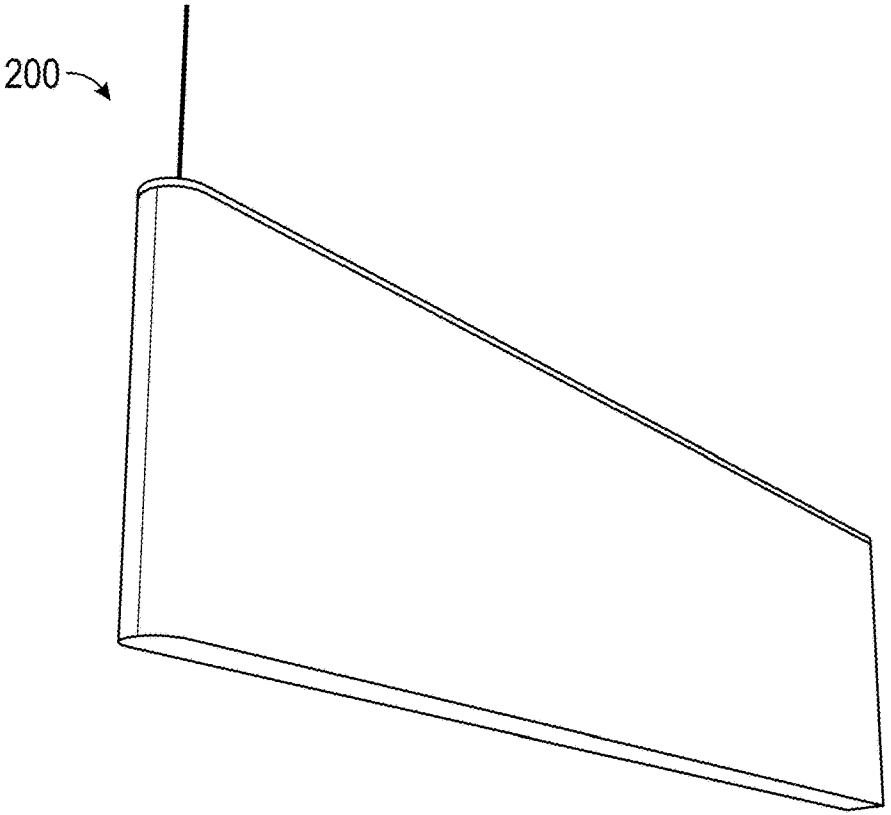
FIG. 6A is a perspective view of another embodiment of the light fixture in accordance with the present disclosure.

The shade 104 is positioned relative to the light engine 102 to conceal the light engine 102 and to receive and diffuse light emitted therefrom. The shade 104 is generally formed of one or more shade walls 140. In the embodiments illustrated in FIG. 1, the shade 104 is generally rectangular shaped and more specifically includes opposing lateral side walls 140*a*, 140*b*, opposing end walls 140*c*, 140*d*, a bottom wall 140*e*, and a top wall 140*f* opposite the bottom wall 140*e*. However, the shade 104 may be formed in other shapes and thus possess different numbers and orientations of shade walls 140. Moreover, while the shade walls 140 are shown as flat, planar surfaces, they could be bent, curved, or otherwise non-planar. For example, FIG. 6A shows an embodiment of a light fixture 200 with a shade having curved end walls. FIG. 6B shows an embodiment of a light fixture 300 having arc-shaped side walls. The shade 104 may be formed in other geometrical shapes such as, but not limited to, cylinder, cone, square, cube, pyramid, etc.

The shade 104 may be formed from any material that diffusely transmits light. In some embodiments, it is desirable that the material have a light transmission rate of at least 60%, at least 65%, at least 70%, at least 75%, at least 80%, at least 85%, at least 90%, and/or at least 95%. While the shade 104 may be formed of rigid materials, in some embodiments the shade 104 is formed of a pliable material that permits the shade 104 to be folded, wrapped, or otherwise collapsed such that the footprint of the shade (and thus of the overall light fixture 100) may be reduced when the light fixture 100 is in an un-installed state. The shade 104 may be formed from any flexible or pliable material that diffuses light, such as, but not limited to, fabric materials, thin polymeric materials, and/or paper materials. In some embodiments, the shade 104 is formed of a diffusing fabric material, such as, but not limited to, nonwoven polypropylene (PP). While the fabric may have any fiber density, fabrics having fiber densities between 60 to 100 grams per square meter (GSM) may be suitable for some applications.

While the shade 104 may be formed integrally, in some embodiments panels of the diffuser material are formed and attached at seams between the shade walls 140 to create the shade 104. The panels forming the shade 104 may be assembled using French seams, Serger seams, folded hems, bias bound seams or any other sewing or attachment methods known in the art. In the illustrated embodiment of FIG. 1, seams 163 extend in an X, Y, and Z-direction along the shade 104. The resulting shade 104 includes shade walls 140 that form continuous luminous faces on the shade 104. Seams 163 can help impart structure to the shade 104. More than one shade wall 140 may be formed by a panel such that a seam 163 need not be present at the intersection of all adjacent shade walls 140.

Figure 8:
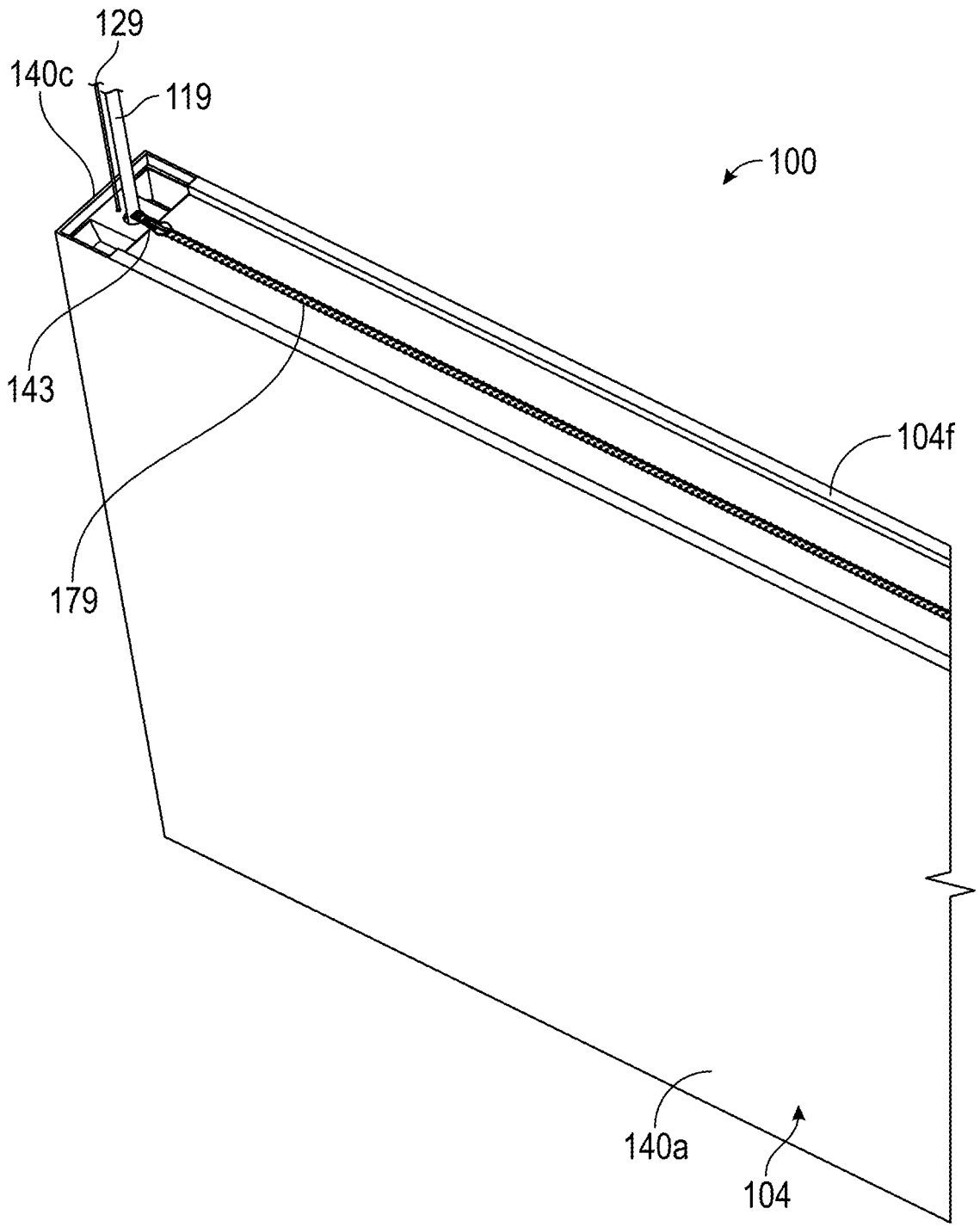
FIG. 8 is an enlarged view of a top portion of the embodiment of a light fixture of FIG. 1.

The shade 104 may be attached to the light engine 102 using any number of attachment means, including, but not limited to, chemical (e.g., adhesives) or mechanical (e.g., screws, clips, etc.) attachment means. In some embodiments, the shade 104 extends over the light engine 102 such that the light engine 102 is covered by, and concealed within, the shade 104. In some embodiments, the top wall 140*f* of the shade 104 is positioned over and supported by the mount body 106 such that the shade 104 is essentially suspended from the light engine 102. In one such embodiment (see FIG. 8), at least one opening or slot 179 with a closure mechanism is formed in the top wall 140*f* of the shade 104. The closure mechanism is shown as a zipper 143 but other mechanisms (adhesive tape, hook and loop fasteners, etc.) could be provided to close the slot 179. The light engine 102 is received within the slot 179 and the zipper 143 is closed to secure the shade 104 to the light engine 102. In some embodiments, the closure mechanism permits repeated opening and closing of the slot 179.

Additional structure may be provided in the shade 104 to impart structural rigidity and integrity to the shade 104. For example, one or more shade tensioning members (collectively 160) may be provided to extend along at least a portion of the bottom wall 140*e* of the shade 104 and may be of sufficient weight to impart rigidity across the bottom of the shade and to tension some or all of the shade walls 140. The various embodiments of the shade tensioning members 160 disclosed herein may be affixed to the shade 104 or may be insertable and removeable from the shade 104 (such as, e.g., via a slit and/or pocket in a wall 140 of the shade 104). In some embodiments, the shade tensioning member 160 is suspended from the light engine 102 via at least one tension wire 176 (see FIGS. 9B and 9C) to ensure that the shade 104 is not placed under excessive force or tension and to provide an additional safety precaution if the shade 104 was to fall.

Figure 9A:
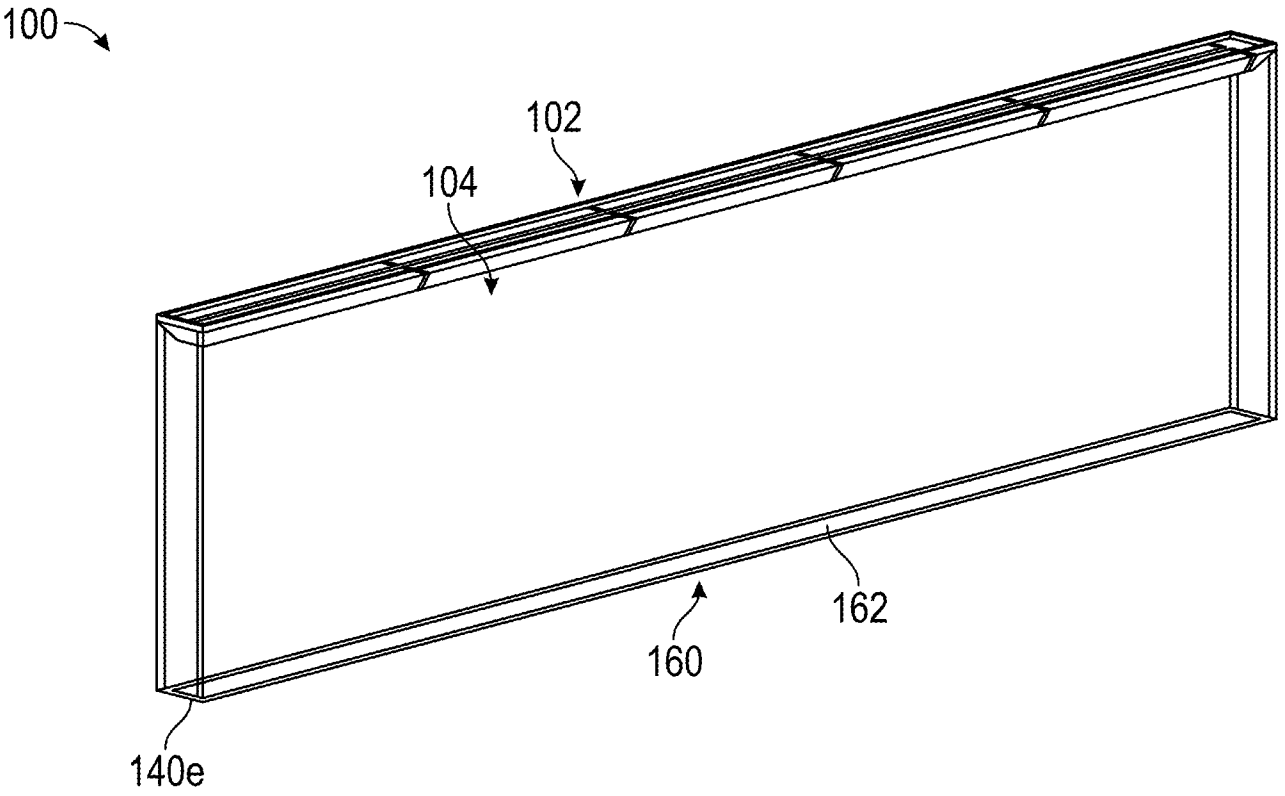
FIG. 9A is a perspective view of a first embodiment of a tensioning member positioned within an embodiment of a light fixture in accordance with the present disclosure.
Figure 9B:
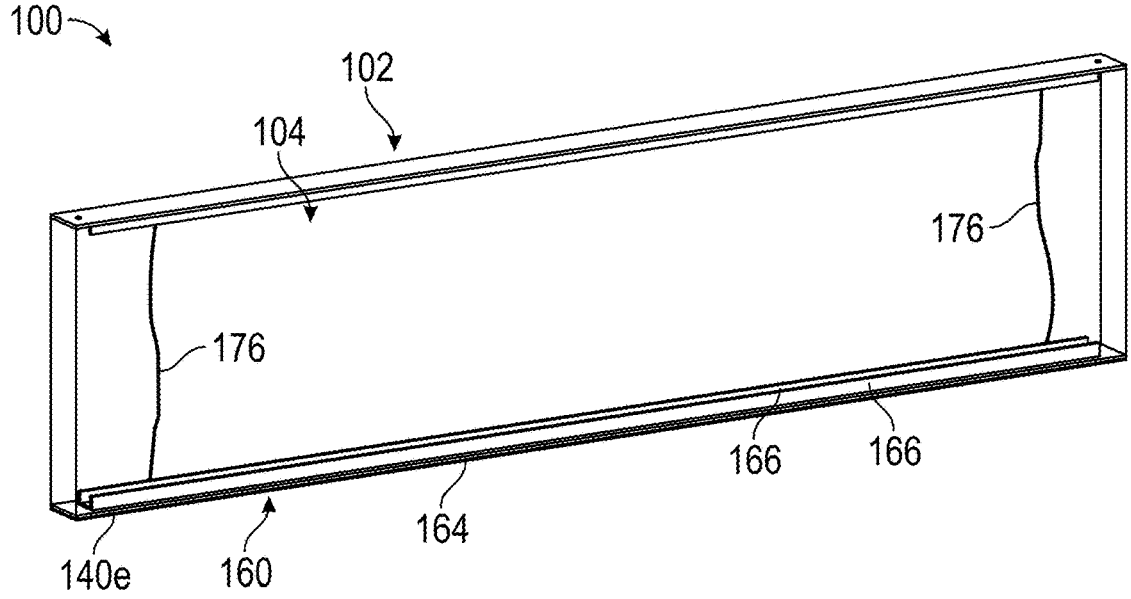
FIG. 9B is a perspective view of a second embodiment of a tensioning member positioned within an embodiment of a light fixture in accordance with the present disclosure.
Figure 9C:
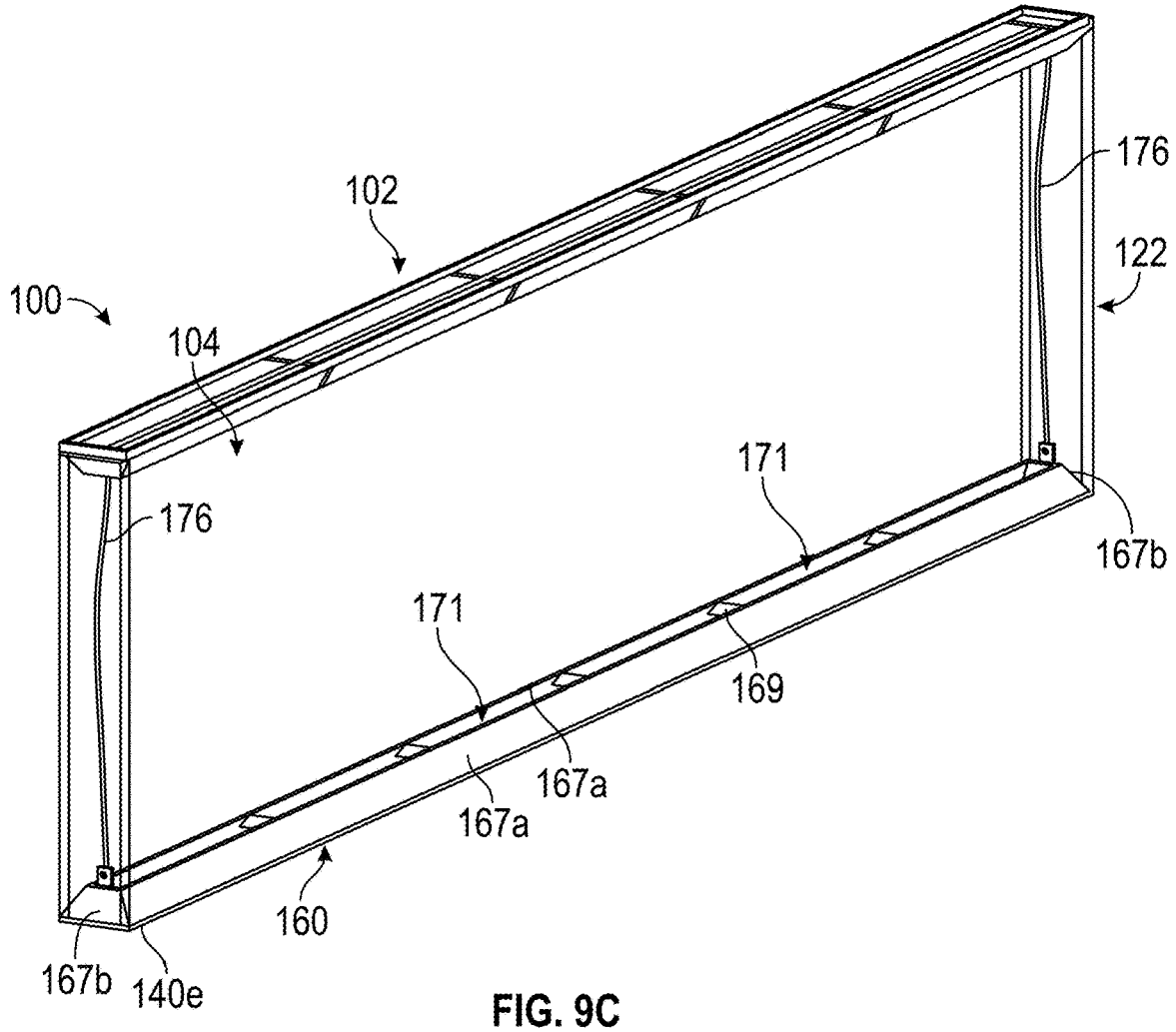
FIG. 9C is a perspective view of a third embodiment of a tensioning member positioned within an embodiment of a light fixture in accordance with the present disclosure.

In FIG. 9A, the shade tensioning member 160 is in the form of a planar insert 162. The thickness of the planar insert 162 may be adjusted to achieve the desired weight and/or rigidity. In FIG. 9B, the shade tensioning member 160 includes a solid planar bottom wall 164 with upwardly extending arms 166 on the lateral sides of the bottom wall 164 that impart additional weight and/or rigidity. In FIG. 9C, shade tensioning member 160 includes opposing longitudinal sidewalls 167*a* and end walls 167*b* that form an outer frame. The longitudinal sidewalls 167*a* are connected by lateral arms 169 at discrete locations along the length of the longitudinal sidewalls 167*a* to define a plurality of central apertures or openings 171 through which light may pass to illuminate the bottom wall 140*e*. The surfaces of longitudinal sidewalls 167*a* and/or end walls 167*b* may be beveled to slant upwardly and inwardly from the bottom wall 140*e* of the shade 104. This bevel or slant diffusely reflects impinging light to thus reduce shadowing areas and render the shade tensioning member 160 virtually or entirely invisible within the shade 104 so as not to disturb the uniformity or continuity of light emitted from the shade.

Shade tensioning members 160 can be formed from opaque materials (e.g., metals, opaque plastics) that impede light from emitting from the bottom wall 140*e* of the shade 104 or can be formed of a transparent or translucent material (e.g., plastics, such as polyethylene terephthalate (PET) or acrylic (PMMA)) that permits light to emit from the bottom wall 140*e* of the shade 104. For example, the shade tensioning member 160 of FIG. 9A may be formed of a transparent or clear material that is positioned at the bottom wall 140*e* of the shade 104, whereas the shade tensioning members 160 shown in FIGS. 9B and 9C may be formed of an opaque material. Or the opposite could be the case. The surfaces of the shade tensioning members 160 may be rendered reflective (such as by application of a reflective coating or paint) to diffusely reflect light.

Figure 9D:
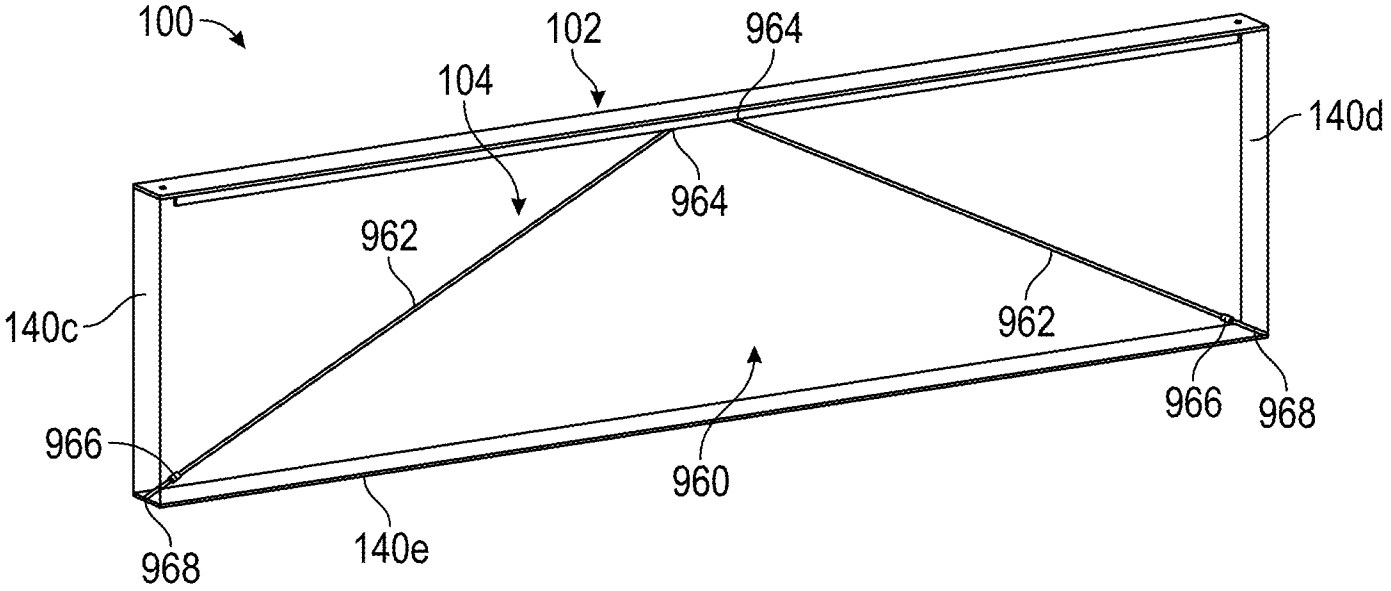
FIG. 9D is a perspective view of a fourth embodiment of a tensioning member positioned within an embodiment of a light fixture in accordance with the present disclosure.

FIG. 9D shows a tension arm mechanism 960 that may be used to tension the shade 104. The tension arm mechanism includes a pair of tension arms 962 which each have a first end 964 and an opposite second end 966. The first end 964 of each tension arm 962 is coupled to the mount body 106. The tension arms 962 are spring-loaded to bias the second end 966 of each tension arm 962 towards the bottom of the shade 104 and apply tension thereto. In the illustrated embodiments, the second end 966 of each tension arm 962 applies tension to the bottom corners of the shade 104. Any number of tension arms 962 may be used. Moreover, additional structure may be added to the tension arms 962 to distribute more evenly the tension across the shade. By way only of example, feet 968 may be provided on the second end 966 of tension arms 962 so as extend along at least a portion of the length of some of the seams formed at the bottom corners of the shade 104. In some embodiments, the tension arms 962 are hingedly coupled to the mount body 106 as to allow for the tension arms 962 to be more easily collapsible for storage and shipping. The tension arms 962 do not obstruct the bottom wall 140*e* of the shade 104, allowing for light to easily be transmitted through the bottom wall 140*e*.

Figure 10:
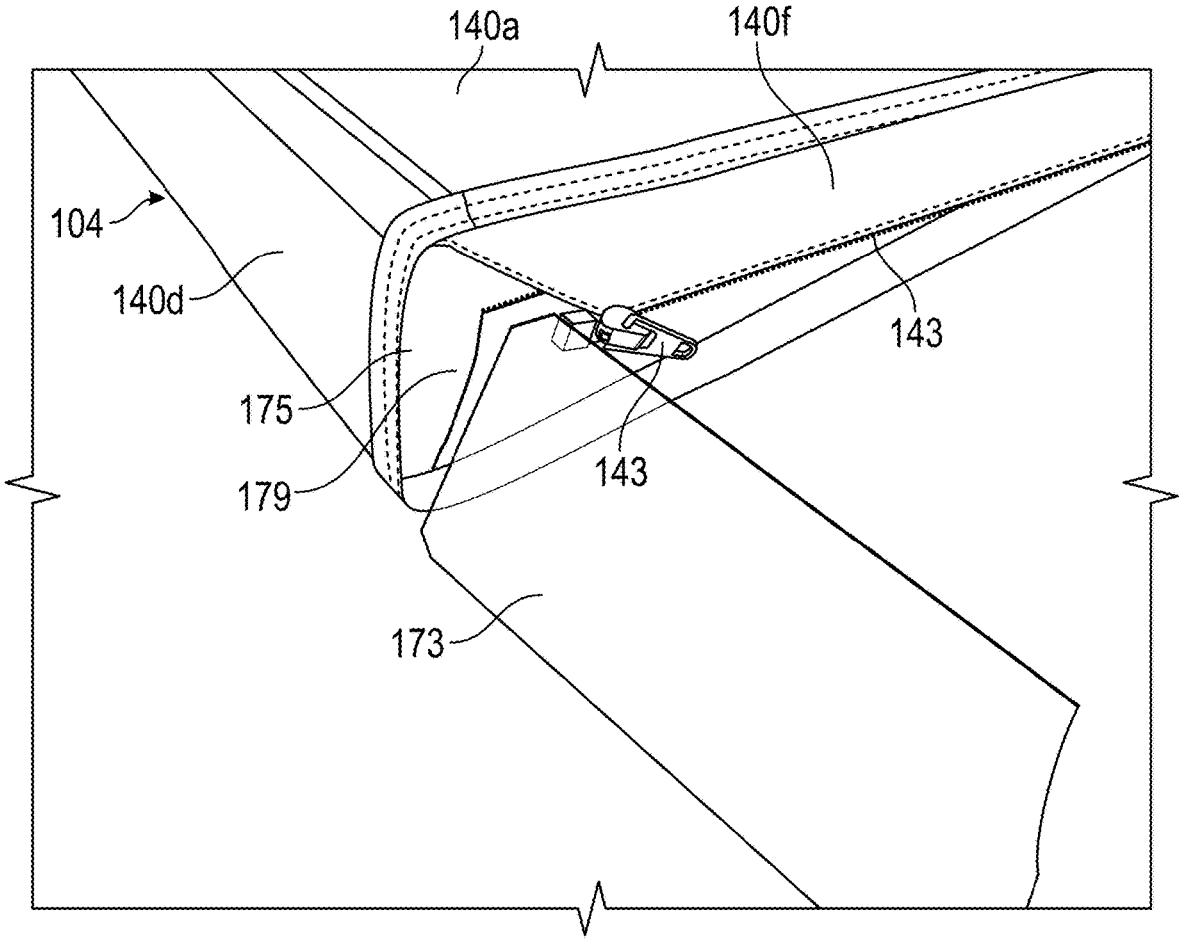
FIG. 10 is an enlarged view of a side portion of the light fixture of FIG. 1.

In some embodiments, one or more structural inserts 173 (see FIG. 10) may be used (in addition to or in place of a shade tensioning member 160 or tension arm mechanism 960) to impart additional form and structure to the shade 104. The structural inserts 173 may be positioned proximate any of the shade walls 140 and provide additional strength and rigidity to the shade 104. In some embodiments, structural inserts 173 are provided along opposing end walls 140*c*, 140*d*. The structural inserts 173 may be affixed to the shade 104 or may be insertable and removeable from the shade 104 (such as, e.g., via a slit in a shade wall 140). The structural inserts 173 may be inserted into pockets 175 formed in the shade walls 140 or otherwise retained within the shade 104. The structural inserts 173 may be formed of a clear material (e.g, plastic) so as not to obstruct light passing through the shade walls 140 or may be colored to alter the output of light and change the aesthetic characteristics of the lighting fixture 100. The structural inserts 173 may also be opaque should it be desired to block light from exiting a particular shade wall 140. In some embodiments, the structural inserts 173 may be manufactured or configured to match the shape of the shade walls 140 they are intended to support.

Additionally, and as shown in FIG. 3, at least one top rail 177 may be positioned along the top wall 140*f*. FIG. 3 illustrates two rails 177, however more or less (or none) may be used. The rails 177 extend at or along the intersection between the top wall 140*f* and the top edges of the lateral side walls 140*a*, 140*b*. However, rails 177 could be provided along any seam 163 in the light fixture 100. In the illustrated embodiment, the rails 177 are in the form of a rod or cord but could assume other shapes and may be coupled to or sewn into the seams 163 between the top wall 140*f* and the lateral side walls 104*a*, 140*b*. Moreover, the top rail 177 may be made of a variety of materials including, but not limited to, plastic, foam, or fabric. The rails 177 define a recess 181 therebetween in which the top wall 140*f* may sit recessed, thus concealing from view the zipper 143 or other attachment mechanisms from any angle below the fixture 100. In addition, the rails 177 may provide additional structure and support at the seam 163 between the top wall 140*f* and the lateral side walls 104*a*1, 140*b*.

Figure 7A:
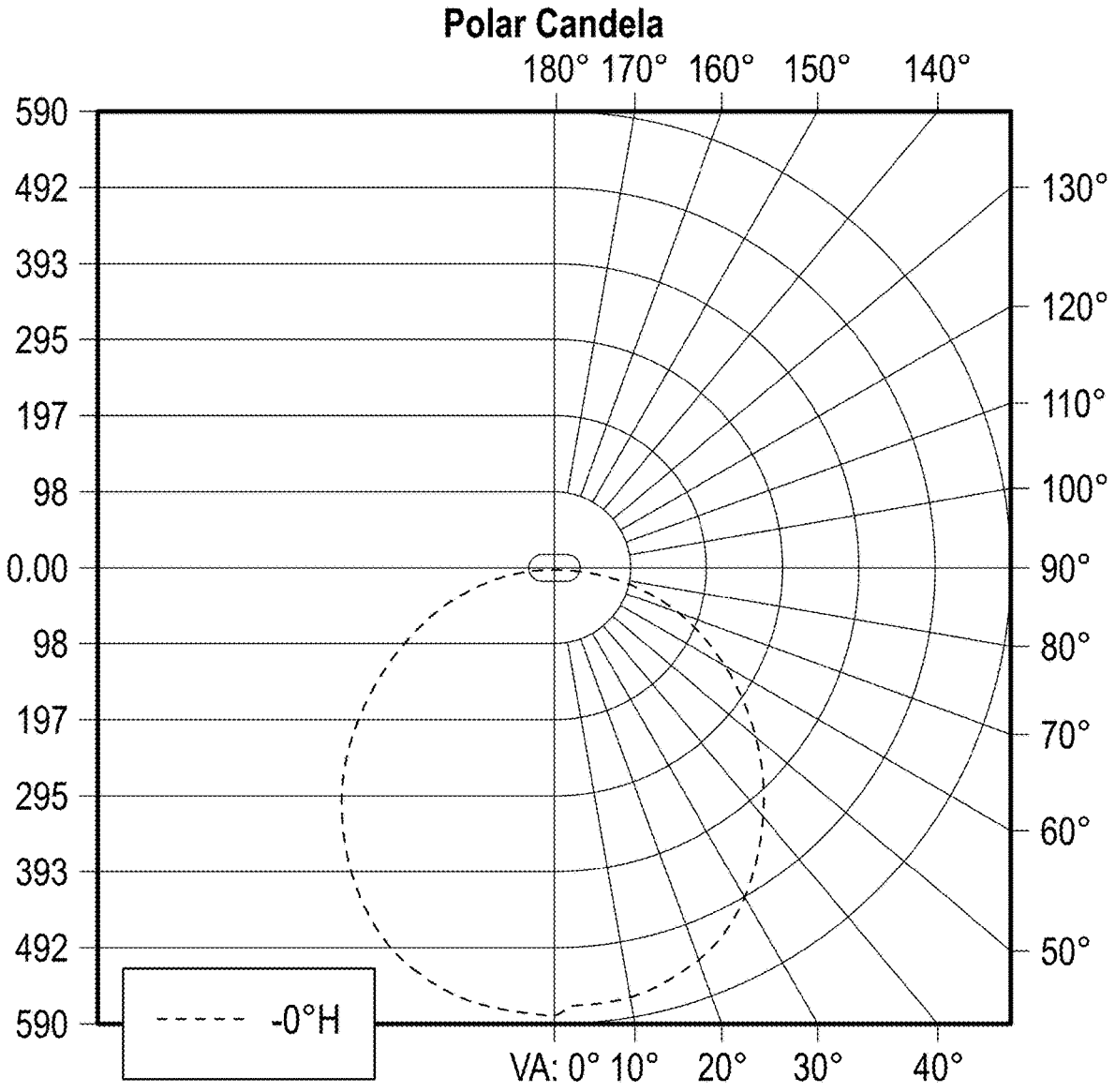
FIG. 7A is a luminous intensity polar light distribution graph of one embodiment of light emitted from at least one light source of the light fixture of FIG. 1.
Figure 7B:
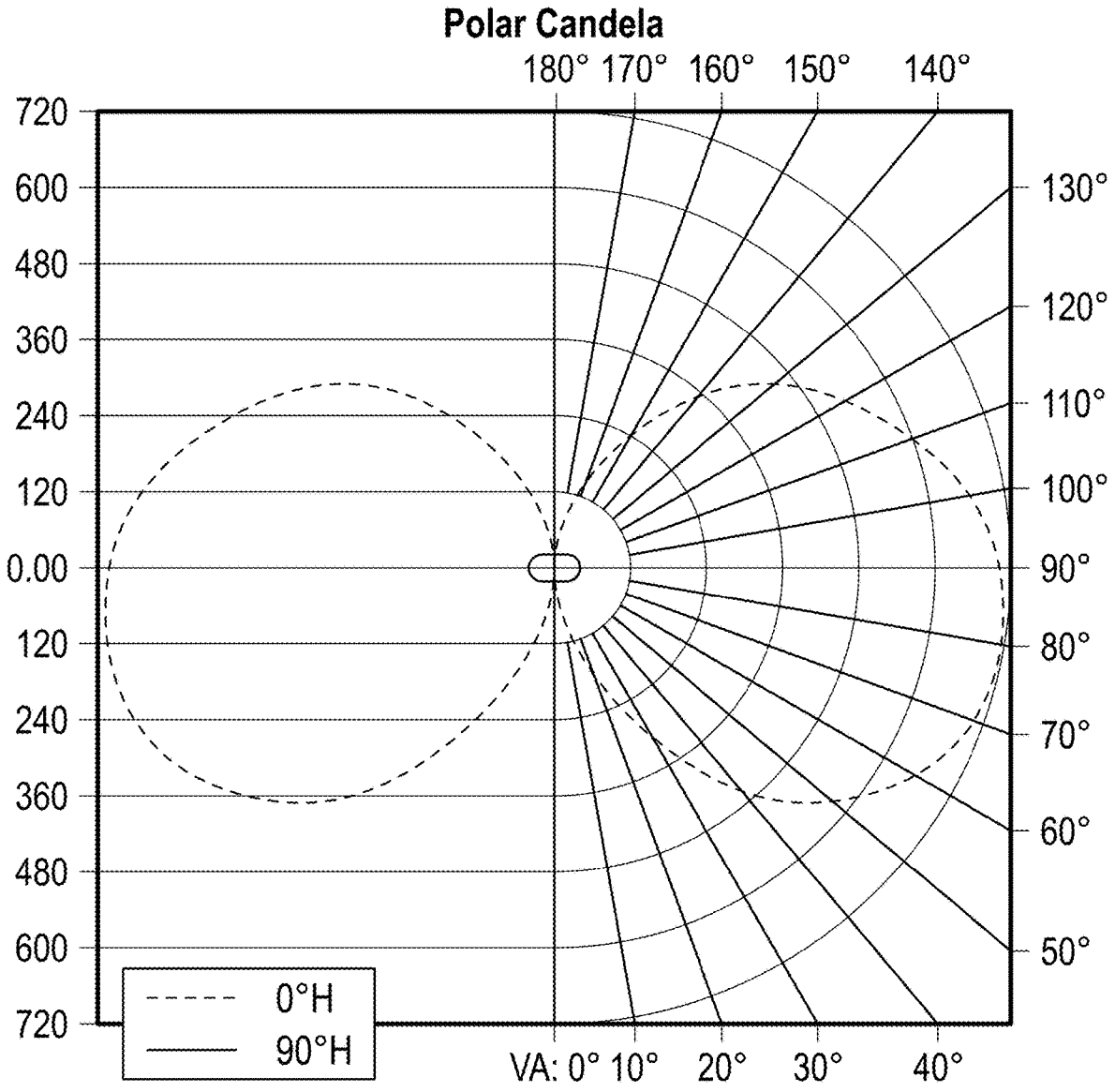
FIG. 7B is a luminous intensity polar light distribution of one embodiment of light emitted from light fixture of FIG. 1

In use, the light sources 108 emit light into the channel 120. Some of the emitted light exits directly through the optical film 134 and into the shade 104, while other of the emitted light is reflected off of the inner walls 122 of lateral wings 118*a*, 118*b* and then through the optical film 134. Regardless, in some embodiments the optical film 134 effectively narrows the angle of the emitted light passing through the optical film 134 to reduce high angle light. The narrowed light then impinges upon the shade 104 and exits the light fixture 100 from the shade walls 140. In some embodiments, some of the light exits the light fixture 100 from the opposing lateral side walls 140*a*, 140*b* and opposing end walls 140*c*, 140*d*. Thus, light emitted from the light source having a generally Lambertian distribution (see FIG. 7A) in a first (e.g., downward) direction exits the light fixture 100 in a generally Lambertian distribution but in at least one second (e.g., outward) direction that is at an angle to the first direction (see FIG. 7B). The terms "first direction" and "second direction" as used herein refer to the direction of the angle of maximum luminous intensity in the distribution. In some embodiments, the second direction is approximately 90° relative to the first direction.

Moreover, the reflective outer walls 124 of lateral wings 118*a*, 118*b* diffusely reflect light outwardly toward the shade 104 to help prevent dark spots or shadows near the top of the shade 104. This also renders the light engine 102 substantially or entirely invisible within the shade 104 when the light fixture 100 is illuminated. This same phenomenon applies to the opaque shade tensioning members 160 provided at the bottom of the shade 104 (should they be used), such as the beveled longitudinal sidewalls 167*a* and/or end walls 167*b* shown in the embodiment of FIG. 9C. In some embodiments, some or all of the walls 140 of the shade 104 appear uniformly lit during use. However, in other embodiments, a gradient of light exists down the height of the shade.

Moreover, in some embodiments light exits the light fixture 100 downwardly via the bottom wall 140*e* of the shade 104 (or just via the bottom of the shade 104 if it does not have a bottom wall 140*e*) to further illuminate the space, particularly the space directly below the light fixture 100. It is also contemplated that one or more light sources may be provided to emit light upwardly from the light fixture and toward the ceiling. For example, light sources could be provided on the top surface 113 of the top plate 112 of mount body 106 such that the resulting light fixture provides both uplight and downlight.

Given the pliable nature of the material from which the shade 104 is formed, light fixtures 100 in accordance with some embodiments may be broken down for shipment and storage by rolling, wadding up, crumpling, or otherwise collapsing the shade 104 but then deploying the shade 104 to create large luminance surfaces for use. In other words, some light fixtures 100 contemplated herein are configured to have deployed dimensions that are significantly greater than their reduced dimensions for storage and shipment. In some embodiments, the shade 104 is capable of or configured to wrap around the light engine 102 or essentially conform to the shape of the light engine 102. In some embodiments, the volume defined by the shade 104 when the light fixture is installed for use can essentially be eliminated for shipment and storage such that the dimensions of the light fixture 100 in a collapsed or stored state are substantially the same as the dimensions of the light engine 102 alone. This reduces storage and shipment costs.

The various aspects, embodiments, implementations, or features of the described embodiments can be used separately or in any combination. In particular, it should be appreciated that the various elements of concepts from FIGS. 1-10 may be combined without departing from the spirit or scope of the invention.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, or gradients thereof, unless otherwise indicated herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall results as if absolute and total completion were obtained.

Preferred embodiments of this invention are described herein, including the best mode known to the inventors for carrying out the invention. The invention is susceptible to various modifications and alternative constructions, and certain shown exemplary embodiments there are shown in the drawings and have been described above in detail. Variations of those preferred embodiments, within the spirit of the present invention, may become apparent to those of ordinary skill in the art upon reading the foregoing description. The inventors expect skilled artisans to employ such variations as appropriate, and the inventors intend for the invention to be practiced otherwise than as specifically described herein. Accordingly, it should be understood that there is no intention to limit the invention to the specific form or forms disclosed, but on the contrary, this invention includes all modifications and equivalents of the subject matter recited in the claim appended hereto as permitted by applicable law. Moreover, any combination of the above-described elements in all possible variations thereof is encompassed by the invention unless otherwise indicated herein or otherwise clearly contradicted by context. The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A light fixture having a top end and a bottom end and comprising:

a light engine positioned proximate the top end and comprising a mount body that supports at least one light source, wherein the at least one light source is oriented to emit light in a first direction toward the bottom end of the light fixture; and a shade supported on the light engine and comprising at least one lateral shade side wall that extends downwardly from the light engine and defines a shade volume, wherein the at least one lateral shade side wall is formed of a light transmissive, pliable material and wherein the shade is adapted to diffuse light emitted from the at least one light source outwardly from the light fixture through the at least one lateral shade side wall in a second direction that is at an angle to the first direction, wherein the mount body defines a channel that extends a length of the mount body and wherein the at least one light source emits light into the channel.

2. The light fixture of claim 1, wherein the material comprises a fabric having a light transmission rate of at least 60%.

3. The light fixture of claim 1, wherein the shade is configured to be moved between an expanded configuration and a collapsed configuration, wherein the shade volume in the collapsed configuration is less than the shade volume in the expanded configuration.

4. The light fixture of claim 3, wherein the shade is adapted to wrap around the light engine when the shade is in the collapsed configuration.

5. The light fixture of claim 1, wherein the at least one lateral shade side wall comprises a first lateral shade side wall and an opposing second lateral shade side wall connected to the first lateral shade side wall by a first lateral shade end wall and an opposing second lateral shade end wall, wherein the shade is adapted to diffuse light emitted from the at least one light source outwardly from the light fixture through the first lateral shade side wall, the second lateral shade side wall, the first lateral shade end wall, and the second lateral shade end wall.

6. The light fixture of claim 5, wherein the first lateral shade side wall and the second lateral shade side wall extend parallel to each other.

7. The light fixture of claim 6, wherein the first lateral shade end wall and the second lateral shade end wall extend parallel to each other and perpendicular to the first lateral shade side wall and the second lateral shade side wall.

8. The light fixture of claim 7, wherein the shade further comprises a bottom shade wall proximate the bottom end of the light fixture and wherein the shade is adapted to diffuse light emitted from the at least one light source through the bottom shade wall.

9. The light fixture of claim 1, wherein the at least one lateral shade side wall is planar.

10. The light fixture of claim 1, wherein the at least one lateral shade side wall is curved.

11. The light fixture of claim 1, wherein the light fixture further comprises a shade tensioning member positioned within the shade to engage the shade proximate the bottom end of the light fixture, wherein the shade tensioning member is adapted to tension the at least one lateral shade side wall.

12. The light fixture of claim 11, wherein the shade tensioning member comprises an outer frame that defines at least one central aperture.

13. The light fixture of claim 12, wherein the outer frame comprises at least one beveled outer surface.

14. The light fixture of claim 1, wherein the light engine is housed within the shade.

15. The light fixture of claim 14, wherein the light engine is substantially invisible within the shade when light is emitted by the light source into the shade.

16. The light fixture of claim 1, wherein the shade further comprises a top shade wall positioned over an upper surface of the light engine such that the shade is suspended from the light engine.

17. The light fixture of claim 1, further comprising a structural insert positioned adjacent the at least one lateral shade side wall and adapted to impart rigidity to the at least one lateral shade side wall.

18. The light fixture of claim 1, wherein the mount body supports an optical film configured to narrow light emitted by the at least one light source such that a beam angle of the light entering the optical film is greater than a beam angle of light exiting the optical film.

19. The light fixture of claim 1, wherein the mount body further comprises at least one angled reflective outer wall positioned within the shade to reflect light outwardly from the light fixture.

20. A light fixture having a top end and a bottom end and comprising:

a light engine positioned proximate the top end and comprising a mount body that supports at least one light source, wherein the at least one light source is oriented to emit light in a first direction toward the bottom end of the light fixture;

a shade supported on the light engine and comprising at least one lateral shade side wall that extends downwardly from the light engine and defines a shade volume, wherein the at least one lateral shade side wall is formed of a light transmissive, pliable material and wherein the shade is adapted to diffuse light emitted from the at least one light source outwardly from the light fixture through the at least one lateral shade side wall in a second direction that is at an angle to the first direction; and a structural insert positioned adjacent the at least one lateral shade side wall and adapted to impart rigidity to the at least one lateral shade side wall, wherein a pocket formed along the at least one lateral shade side wall is adapted to receive the structural insert.

21. A light fixture having a first end and an opposing second end and comprising:

a light engine positioned proximate the first end of the light fixture and comprising a mount body that supports at least one light source, wherein the at least one light source is oriented to emit light toward the second end of the light fixture; and a shade extending from the light engine toward the second end of the light fixture, wherein the shade comprises a shade volume defined by a first lateral shade side wall, a second lateral shade side wall opposite the first lateral shade side wall, a first lateral shade end wall extending between the first and second lateral shade side walls, a second lateral shade end wall extending opposite the first lateral shade end wall and between the first and second lateral shade side walls, and a second end shade wall proximate the second end of the light fixture and extending between the first and second lateral shade side walls and the first and second lateral shade end walls, wherein the first lateral shade side wall, the second lateral shade side wall, the first lateral shade end wall, the second lateral shade end wall, and the second end shade wall are formed of a light transmissive fabric material and are adapted to diffuse light emitted from the at least one light source outwardly from the light fixture, wherein the shade is configured to be moved between an expanded configuration and a collapsed configuration, wherein the shade volume in the collapsed configuration is less than the shade volume in the expanded configuration, and wherein the mount body defines a channel that extends a length of the mount body and wherein the at least one light source emits light into the channel.

* * * * *